US005263782A

United States Patent [19]

Yageta et al.

[11] Patent Number: 5,263,782

[45] Date of Patent: Nov. 23, 1993

[54] PRINT HAMMER ARRANGEMENT IN DOT LINE PRINTER MINIMIZING NUMBER OF HAMMERS SIMULTANEOUSLY FIRED

[75] Inventors: Kohichi Yageta; Toshio Hiki; Shinichi Watahiki; Kazunari Kodama, all of Katsuta, Japan

[73] Assignee: Hitachi Koki Co. Ltd., Japan

[21] Appl. No.: 853,600

[22] Filed: Mar. 18, 1992

[30] Foreign Application Priority Data

Mar. 18, 1991 [JP] Japan ..... 3-052349
Jan. 22, 1992 [JP] Japan ..... 4-008905

[51] Int. Cl.[5] ..... B41J 2/235

[52] U.S. Cl. ..... 400/121; 101/93.04; 101/93.09; 101/93.48

[58] Field of Search ..... 101/93.04, 93.05, 93.29, 101/93.47, 93.48, 93.16, 93.09; 400/124, 121

[56] References Cited

U.S. PATENT DOCUMENTS 4,386,563 6/1983 Farb ..... 101/93.04
4,550,659 11/1985 Yamanaga ..... 101/93.04

FOREIGN PATENT DOCUMENTS 58-11177 1/1983 Japan .

OTHER PUBLICATIONS

IBM Technical Disclosure Bulletin, vol. 27, No. 2, Jul. 1984 "Print Hammer Mounting Arrangment for A Matrix Printer", Lean et al., pp. 1099-1100.

*Primary Examiner*—Edgar S. Burr
*Assistant Examiner*—Lynn D. Hendrickson
*Attorney, Agent, or Firm*—Sughrue, Mion, Zinn, Macpeak & Seas

[57] ABSTRACT

A dot line printer has a plurality of print hammers accommodated in a hammer bank, which make dot impressions on a sheet of print paper as the hammer bank reciprocally moves in a print line direction perpendicular to the direction in which the sheet of print paper is fed. To print L dot lines at a time with each of forward and backward movements of the hammer bank, the print hammers are divided into a preselected number of groups so that each group includes N number of print hammers where L and N are integers equal to or greater than 3. The print hammers in each group are displaced one dot line distance from one another in the sheet feeding direction. The print hammers in each group are further displaced in the print line direction by respective predetermined distances from their home positions so that the respective hammers in each group do not impinge upon the sheet of print paper simultaneously. The print hammers equal in number to the least common multiple of L and N or integer multiples of the least common multiple thereof are integrally formed into a module structure to facilitate the manufacture and management of the hammer assemblies.

9 Claims, 2 Drawing Sheets

PRINT HAMMER ARRANGEMENT IN DOT LINE PRINTER MINIMIZING NUMBER OF HAMMERS SIMULTANEOUSLY FIRED

BACKGROUND OF THE INVENTION

1. Field of the Invention

The present invention relates generally to a dot line printer, and more particularly to a dot line printer for printing L dot lines at a time during each of forward and backward movements of a hammer bank accommodating therein a plurality of print hammers juxtaposed along a print line, and for minimizing the number of print hammers simultaneously fired, where L is an integer equal to or greater than 3.

2. Description of the Prior Art

In a dot line printer, a print hammer which is a plate-like leaf spring having a print pin at its tip end is held in a non-printing position by a magnetic attraction of a permanent magnet against elastic deformation of the print hammer. The print hammer is released from the non-printing position with a supply of a release current to an electromagnetic coil. The print pin thus impinges upon a sheet of print paper, thereby making a dot impression thereon.

As disclosed in Japanese Patent Publication (Kokoku) No. 55-10385, there is a problem such that if adjacent print hammers are allowed to be fired at the same time, duration of the current supplied to the electromagnetic coil needs to be prolonged or the peak level of the current needs to be increased. To obviate such a problem, this Publication proposes displacing columnar printing types embossed on the periphery of a drum in the circumferential direction with respect to printing types in adjacent column so that adjacent print hammers are not fired at the same time.

Another proposal for solving this problem is disclosed in Japanese Patent Publication (Kokai) No. 58-11177 and Japanese Patent Publication (Kokoku) No. 62-28755, wherein a plurality of print hammers are divided into two groups and respective ones of the print hammers in a second group are displaced from their home positions by a distance corresponding to one half of a reciprocal of a print density (hereinafter referred to as "a half dot") where the print density is represented by a number of printable dots per a unit length. Displacement of the second group print hammers by the half dot reduces electric power consumption and lowers the peak level of the current flowing in the electromagnetic coil. As a consequence, a small-capacity power source can be used for the dot line printer.

However, high speed dot line printers have an increased number of print hammers, say nearly 300, so that the number of simultaneously fired print hammers increases in due course even if the hammers are divided into two groups, thus electrical and mechanical influences caused by the increased number of the hammers are still outstanding in the high speed dot line printers. More specifically, as the number of simultaneously fired print hammers is increased, a total amount of currents flowing in the coils is increased, thus requiring a large-capacity power source. Further, mechanical impact increases as the larger number of print hammers impinge upon a platen at a time. This increased mechanical impact may cause the print gap between the print hammers and the sheet of paper to widen, thus lowering print quality. Magnetic interaction between adjacent hammers is another problem in such high speed printers, because the pitch between the hammers is made small so as to accommodate the increased number of print hammers.

SUMMARY OF THE INVENTION

The present invention has been made to solve the aforesaid problems, and accordingly it is an object of the present invention to provide a high speed dot line printer which minimizes the number of print hammers simultaneously fired.

Another object of the present invention is to provide a dot line printer which can afford good printing quality.

To achieve the above and other objects, there is provided a dot line printer which includes a plurality of print hammers, holding means for holding the plurality of print hammers in non-printing positions with magnetic attractive force, and a plurality of electromagnetic coils provided in one-to-one correspondence to the plurality of print hammers. Each of the plurality of electromagnetic coils are supplied with a current having a predetermined duration to release the print hammer from the non-printing position and to thus make a dot impression on a sheet of print paper by cancellation of the magnetic attractive force with a magnetic field produced by the current flowing in the electromagnetic coil. The plurality of print hammers are accommodated in a hammer bank reciprocally movable with forward and backward movements in a first direction perpendicular to a second direction in which the sheet of print paper is fed. The plurality of print hammers are divided into a plurality of groups so that each group includes N-number print hammers where N is an integer equal to or greater than 3. The N-number print hammers in each group are displaced by a distance corresponding to one dot line in the second direction so that L dot lines are printed with each of forward and backward movements of the hammer bank where L is an integer equal to or greater than 3. Further, positions of $(N-1)$ print hammers in each group are displaced in the first direction from respective home positions by respective predetermined distances so as to prevent the N-number print hammers from being released simultaneously, where the home positions are imaginary positions of the print hammers apart a predetermined equi-distance from position of adjacent print hammer.

More specifically, the positions of $(N-1)$ print hammers in each group are displaced in the first direction by $(n-1)/(N \cdot D)$ from respective home positions, where n is a number of order in which one of the $(N-1)$ print hammers is released, where n is an integer in a range of from 2 to N, and D represents a number of dots printable per a unit length.

With the arrangement of the print hammers as described above, the number of print hammers simultaneously fired are reduced to one N-th (1/N), so that the electrical and magnetic influences which may otherwise be caused if a large number of print hammers are simultaneously fired can be suppressed to an allowable low level. Furthermore, by forming the print hammers equal in number to a least multiple of L and N into a module structure or by forming the print hammers equal in number to an integer multiple of the least multiple of L and N into a module structure, the print hammers can be fabricated with the use of the same kind of module structure hammer assemblies.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Figure 1:
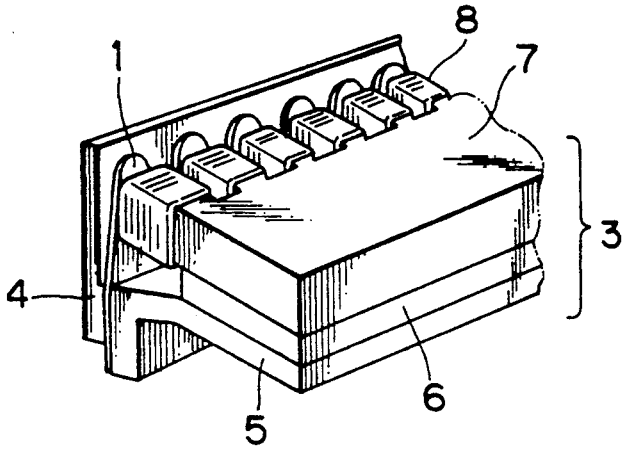
FIG. 1 is a perspective view showing dot print hammers.
Figure 2:
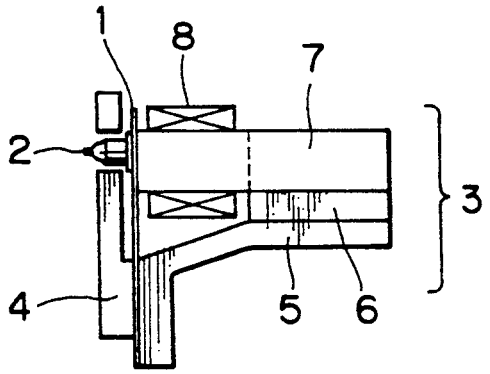
FIG. 2 is a side view showing the print hammer shown in FIG. 1.

An example of a dot print hammer is shown in FIGS. 1 and 2. The print hammer is a plate-like leaf spring 1 having a print pin 2 attached to free end portion of the leaf spring 1. The lower portion of the leaf spring 1 is sandwiched between a front yoke 4 and a yoke base 5 and fixedly secured thereto by virtue of screws. A permanent magnet 6 and a comb-like yoke 7 are fixedly secured to the yoke base 5. The front yoke 4, leaf spring 1, yoke base 5, permanent magnet 6 and the comb-like yoke 7 constitute a magnetic circuit. The upper portion of the leaf spring 1 is magnetically attracted to the pole of the comb-like yoke 7 against elastic deformation of the leaf spring 1 by virtue of the permanent magnet 6. With energization of a release coil 8, the leaf spring 1 releases from the pole of the yoke 7 and the print pin 2 impinges upon a sheet of print paper (not shown), thereby making a dot impression thereon.

In the following description, a dot line printer of the present invention is assumed to print with a print density of 180 dpi (dots per inch) and 6 dot lines are simultaneously printed with each of forward and backward movements of a hammer bank in which the print hammers are accommodated.

Figure 3:
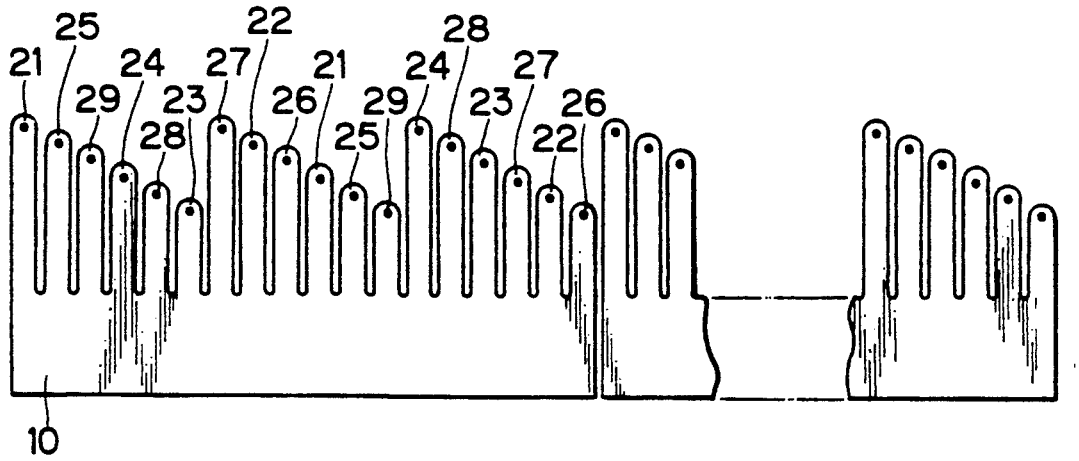
FIG. 3 is a front view showing a print hammer assembly used in a dot line printer according to a first embodiment of the present invention.

FIG. 3 shows an arrangement of the print hammers according to a first embodiment of the present invention. A plurality of module structure print hammer assemblies 10 (only two being shown in FIG. 3 for the sake of brevity) are arranged in alignment with one another along a print line perpendicular to the direction in which a sheet of print paper is fed. Each print hammer assembly 10 is made of a single sheet of leaf spring, wherein 18 print hammers extend upwardly from a common base portion. Print pins denoted by numerals 21 through 29 are secured to upper free end portions of the print hammers by means of welding or caulking. The positions of 6 print pins are displaced vertically or in the paper feeding direction from one another by a distance corresponding to one dot line so that 6 dot lines are simultaneously printed with each of forward and backward movements of the hammer bank. 18 print hammers in each hammer assembly 10 are grouped into two wherein the leftside 9 hammers belong to the same group and the rightside 9 hammers belong to another group. 8 hammers in each group which are successively fired in an order of from second to ninth and are displaced horizontally in a print line direction by respective predetermined distances from their home positions as indicated in Table 1 below so that the hammers in the same group do not impinge on the sheet of paper simultaneously. The number of the print hammers "18" included in each assembly 10 is a least common multiple of "6" and "9" where "6" is the number of simultaneously printable dot lines with each of forward and backward movements of the hammer bank, and "9" is the number of the print hammers contained in each group. The numerals of the print pins indicate an order in which the print hammers are fired in succession.

The hammer assemblies 10 are mounted on a hammer bank which is reciprocally moved in the print line direction by a shuttle mechanism including a motor and a cam or by a linear motor. Representing repeatability or flight time of each hammer by T (milliseconds), fire start interval of the respective print hammers in each group is set to $t=T/9$. That is, the fire start times at which the respective print hammers in each group start firing are delayed every $t=T/9$. The repeatability or flight time T is defined by a period of time starting from the release of the print hammer from the non-printing position to the return to the original non-printing position upon making a dot impression on the sheet of print paper. The speed of the hammer bank v (inch/millisecond) is determined based on both the dot density which is 180 dpi in the instant case, and the repeatability T, i.e., $v=(1/180)/T$ inch/millisecond. A distance x that the hammer bank moves from the time when a particular hammer is fired to the time when the subsequent hammer is fired is given by:

$$v \cdot T/9 = 1/(9 \times 180) = 6.17 \times 10^{-4} \text{ (inch)}$$

Table 1 below indicates distances (D1) of the print pins 22 through 29 measured from the position of the print pin 21, distances (D2) of the print pins 22 through 29 measured from the respective home positions, and distances (D3) of the respective print pins 22 through 29 measured from the position of the immediate leftside print pin. The home positions of the print pin are defined by imaginary print pin positions arranged at a predetermined equi-interval which in the following case is 0.1 inch.

TABLE 1

| | D1 | D2 | D3 |
|---|---|---|---|
| Print pin 22 | $0.1 \times 7 - x$ | x | $0.1 + 5x$ |
| Print pin 23 | $0.1 \times 5 - 2x$ | 2x | $0.1 + 5x$ |
| Print pin 24 | $0.1 \times 3 - 3x$ | 3x | $0.1 + 5x$ |
| Print pin 25 | $0.1 - 4x$ | 4x | $0.1 - 4x$ |
| Print pin 26 | $0.1 \times 8 - 5x$ | 5x | $0.1 - 4x$ |
| Print pin 27 | $0.1 \times 6 - 6x$ | 6x | $0.1 - 4x$ |
| Print pin 28 | $0.1 \times 4 - 7x$ | 7x | $0.1 - 4x$ |
| Print pin 29 | $0.1 \times 2 - 8x$ | 8x | $0.1 - 4x$ |

Assuming that the print pin 21 is fired when the rightwardly moving hammer bank is instantaneously at some location, the print pin 22 is subsequently fired after expiration of time t ($=T/9$) from the firing of the print pin 21. During the period of time t, the hammer bank moves rightwardly a distance x. The print pin 22 is the seventh pin counted rightwardly from the print pin 21 and the home position of the print pin 22 is apart by 0.7 inch from the position of the print pin 21. Therefore, the position of the print pin 22 is leftwardly displaced by a distance x from its home position as can be seen from Table 1. The print pin 27 is the immediate leftside print pin of the print pin 22, and the position of the print pin 27 is leftwardly displaced by a distance 6x from its home position, so that the position of the print pin 22 is apart by 0.1+5x from the position of the print pin 27. In this manner, assuming that print commands for the print pins 23 through 29 are present, these print pins are successively fired each time with a delay of time t with respect to the firing of the immediate preceding print pin. After expiration of time t after the firing of the print pin 29, the print pin 21 has returned to its original position and is placed ready for the subsequent firing.

With the hammer arrangement as shown in Table 1, the number of the print hammers which simultaneously impinge upon the sheet of print paper is reduced to one ninth (1/9). If the total number of print hammers is 300, maximum number of the print hammers which impinge upon the sheet of print paper at a time is 34. As the number of the simultaneously fired print hammers are greatly reduced, the peak level of the current flowing in the coils is reduced, so a small-capacity power source suffices for the dot line print having the hammer arrangement as described above. Further, the mechanical impact upon the platen is reduced, high print quality can be maintained at all times.

In the first embodiment describe above, the print hammers in each group are fired in a predetermined scrambled order, but they can be fired in a regular order from left to right. In the latter case, the positions of the print pins 22 through 29 relative to the position of the leftmost print pin 21 are determined depending on the firing order.

A second embodiment of the present invention will be described with reference to FIG. 4. A plurality of module structure print hammer assemblies 101 are arranged in alignment with one another in the print line direction. Each print hammer assembly 101 is made of a single sheet of leaf spring, wherein 6 print hammers extend upwardly from a common base portion. The positions of 6 print pins in the module structure are displaced vertically or in the paper feeding direction from one another by a distance corresponding to one dot line so that 6 dot lines are simultaneously printed with each of forward and backward movements of the hammer bank. 6 print hammers in each hammer assembly 101 are grouped into two wherein leftside 3 hammers belong to the same group and the rightside 3 hammers belong to another group. 2 hammers in each group which are successively fired in an order of from second to third are displaced horizontally or a print line direction by respective predetermined distances from their home positions as indicated in Table 2 below. The number of the print hammers "6" in each assembly 101 is a least common multiple of "6" and "3" where "6" is the number of simultaneously printable dot lines with each of forward and backward movements of the hammer bank, and "3" is the number of the print hammers contained in each group. The numerals of the print pins indicate an order in which the print hammers are fired in succession.

Figure 4:
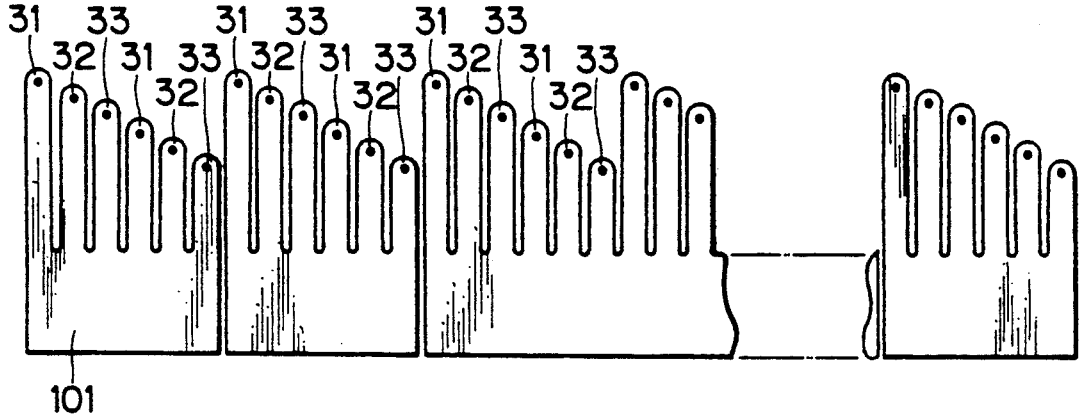
FIG. 4 is a front view showing a print hammer assembly in a dot line printer according to a second embodiment of the present invention.

In the arrangement shown in FIG. 4, fire start interval at which the respective print hammers in each group start firing is set to t=T/3. That is, fire start times at which the respective print hammers in each group start firing are delayed every t=T/3. A distance x that the hammer bank moves from the time when a particular hammer is fired to the time when the subsequent hammer is fired is given by:

$$v \cdot T/3 = 1/(3 \times 180) = 1.85 \times 10^{-3} \text{ (inch)}$$

where the print density is also assumed to be 180 dpi.

Table 2 below indicates distances (D1) of the print pins 32 and 33 measured from the position of the print pin 31, distances (D2) of the print pins 32 and 33 measured from the respective home positions, and distances (D3) of the respective print pins 32 and 33 measured from the position of the immediate leftside print pin.

TABLE 2

| | D1 | D2 | D3 |
|---|---|---|---|
| Print pin 32 | 0.1 × 1 − x | x | 0.1 − x |
| Print pin 33 | 0.1 × 2 − 2x | 2x | 0.1 − x |

With the hammer arrangement as shown in Table 2, the number of the print hammers which simultaneously impinge upon the sheet of print paper is reduced to one third (⅓). If the total number of print hammers is 300, maximum number of the print hammers which impinge upon the sheet of print paper at a time is 100.

A third embodiment of the present invention will be described with reference to FIG. 5. A plurality of module structure print hammer assemblies 102 are arranged in alignment with one another in the print line direction. Each print hammer assembly 102 is made of a single sheet of leaf spring, wherein 12 print hammers extend upwardly from a common base portion. The positions of 6 print pins in the module structure are displaced in the paper feeding direction from one another by a distance corresponding to one dot line so that 6 dot lines are simultaneously printed with each of forward and backward movements of the hammer bank. 12 print hammers in each hammer assembly 102 are grouped into three wherein leftside 4 hammers belong to a first group, intervening 4 hammers belong to a second group, and rightside 4 hammers belong to a third group. 3 hammers in each group which are successively fired in an order of from second to fourth are displaced horizontally or a print line direction by respective predetermined distances from their home positions as indicated in Table 3 below. The number of the print hammers "12" in each assembly 102 is a least common multiple of "6" and "4" where "6" is the number of simultaneously printable dot lines with each of forward and backward movements of the hammer bank, and "4" is the number of the print hammers contained in each group. The numerals of the print pins indicate an order in which the print hammers are fired in succession.

Figure 5:
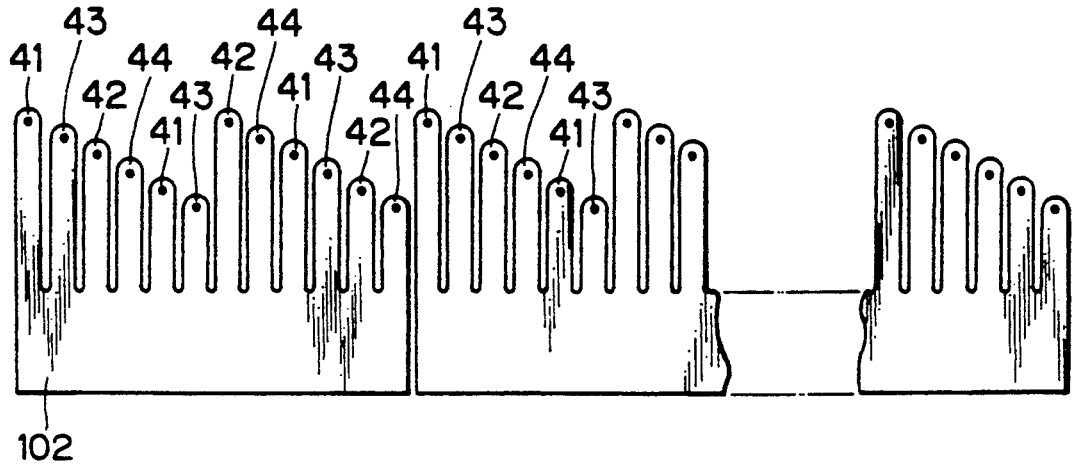
FIG. 5 is a front view showing a print hammer assembly in a dot line printer according to a third embodiment of the present invention.

In the arrangement shown in FIG. 5, fire start interval at which the respective print hammers in each group is set to t=T/4. That is, fire start times at which the respective print hammers in each group start firing are delay every t=T/4. A distance x that the hammer bank moves from the time when a particular hammer is fired to the time when the subsequent hammer is fired is given by:

$$v \cdot T/4 = 1/(4 \times 180) = 1.39 \times 10^{-3} \text{ (inch)}$$

where the print density is also assumed to be 180 dpi.

Table 3 below indicates distances (D1) of the print pins 42 through 44 measured from the position of the print pin 41, distances (D2) of the print pins 42 through 44 measured from the respective home positions, and distances (D3) of the respective print pins 42 through 44 measured from the position of the immediate leftside print pin.

TABLE 3

| | D1 | D2 | D3 |
|---|---|---|---|
| Print pin 42 | $0.1 \times 2 - x$ | x | $0.1 - 2x$ |
| Print pin 43 | $0.1 \times 1 - 2x$ | 2x | $0.1 + x$ |
| Print pin 44 | $0.1 \times 3 - 3x$ | 3x | $0.1 - 2x$ |

With the hammer arrangement as shown in Table 3, the number of the print hammers which simultaneously impinge upon the sheet of print paper is reduced to one third (⅓). If the total number of print hammers is 300, maximum number of the print hammers which impinge upon the sheet of print paper at a time is 75.

While the above embodiments assume that 6 dot lines are simultaneously printed with each of forward and backward movements of the hammer bank, the hammer arrangements can be modified so that 4 or 8 dot lines can be simultaneously printed. Further, although in the embodiments described above, odd numbers 9 and 3 and an even number 4 are selected as the number of the print hammers in each group, the number thereof may be arbitrarily selected if it is an integer equal to or greater than 3. The number of the print hammers in each module structure can be a least common multiple of N and L or integer multiples of the least common multiple of N and L where N represents the number of hammers in each group and L is the number of simultaneously printable dot lines. As described below, it is desirable to select odd numbers for the number N rather than selecting even numbers.

Forming the print hammers into a module structure on a group basis requires at least two kinds of hammer assemblies except the case that N is a number dividable with L, resulting in complicatedness in the manufacture and intricateness of the management of different kinds of print hammer assemblies. Further, if the print hammers are formed into a module structure with a number greater than the least common multiples of N and L excluding the cases of the integer multiples of the least common multiples, a problem is encountered such that the number of hammers included in one module is too large to accurately manufacture the module structure, and is therefore undesirable.

Assuming that an odd number $N_o$ ($N_o = 2n_o + 1$ where $n_o$ is an integer equal to or greater than "1") is selected as the number of print hammers in each group, the minimum firing time difference $t_o$ between adjacent print hammers is given by:

$$t_o = n_o \cdot T/(2n_o + 1)$$

On the other hand, assuming that an even number $N_e$ ($N_e = 2n_e$ where $n_e$ is an integer equal to or greater than "2") is selected as the number of print hammers in each group, the minimum firing time difference $t_e$ is given by:

$$t_e = (n_e - 1) \cdot T/2n_e$$

Since a larger firing time difference is desirable in terms of reducing the magnetic interaction between adjacent print hammers, it can be concluded that odd numbers are better than even numbers if a relationship of $t_o - t_e > 0$ is met.

$$\begin{aligned} t_o - t_e &= T\{n_o/(2n_o + 1) - (n_e - 1)/2n_e\} \\ &= (2n_o - n_e + 1) \cdot T/\{2n_e \cdot (2n_o + 1)\} \\ &= (N_o - N_e/2) \cdot T/(N_e \cdot N_o) \end{aligned}$$

That is, when $N_o > N_e/2$, $t_o$ becomes greater than $t_e$. Therefore, when even numbers are selected, the number of print hammers to be included in each group must be two times as many as the number of print hammers in the case of selecting odd numbers so as to keep the same firing time interval. Consequently, it can be concluded that odd numbers are desirable as the number of the print hammers to be included in each group. If even numbers are selected, problems may be encountered such that the hammers cannot be accurately formed into a module structure and driving control of the hammers is complicated.

In accordance with the present invention, the print hammers belonging to the same group are separately fired at different times, and the number of the simultaneously fired print hammers is reduced to 1/N where N is the number of print hammers included in each group. As a consequence, electrical and mechanical influences can be greatly suppressed and dot line printers capable of affording a high print quality can be provided at low cost. Furthermore, the fabrication of the print hammers can be achieved by the module structure print hammer assemblies of the same kind, the manufacture and the management of the print hammer assemblies can be facilitated.

What is claimed is:

1. A dot line printer comprising:

a hammer bank, said hammer bank comprising a plurality of print hammers, each having a print pin;

means for moving said hammer bank back and forth in a shuttling direction;

holding means for holding said plurality of print hammers in non-printing positions with magnetic attractive force;

a plurality of electromagnetic coils provided in one-to-one correspondence to said plurality of print hammers;

means for supplying a current of a predetermined duration to each of said plurality of electromagnetic coils thereby creating a magnetic field which counteracts the magnetic attractive force produced by said holding means thereby releasing the print hammers from their non-printing positions for making dot impressions on a sheet of print paper; and means for moving said sheet in a line to line direction, wherein said plurality of print hammers of said hammer bank are divided into a plurality of groups so that each group includes N-number print hammers where N is an integer equal to or greater than 3, said N-number print hammers in each group being displaced by a distance corresponding to one dot line in the line to line direction so that L dot lines are printed with each of forward and backward movements of said hammer bank where L is an integer equal to or greater than 3, and wherein said printer further comprises;

means for releasing said N-number print hammers, in each of said groups, in a predetermined successive order, so that only 1/N of said plurality of print hammers are fired simultaneously, and wherein positions of (N−1) print hammers in each group are displaced in the shuttling direction from respective home positions by (n−1)/N·D), where n is a number indicative of an order in which one of said (N−1) print hammers is released, n being an integer in a range of from 2 to N, and D represents a number of dots printable per unit length, as measured in the shuttling direction, to compensate for the successive releasing of the print hammers, said home positions being imaginary positions of said print hammers spaced equidistant from one another, by a predetermined distance.

2. The dot line printer according to claim 1, wherein said print hammers equal in number to at least common multiple of N and L are formed into a module structure.

3. The dot line printer according to claim 1, wherein said print hammers equal in number to an integer multiple of a least common multiple of N and L are formed into a module structure.

4. The dot line printer according to claim 1, wherein N is an odd number.

5. The dot line printer according to claim 1, wherein L and N are equal to 6 and 9, respectively, and wherein said print hammers in each group are arranged so that adjacent print hammers are released with a time delay of 4t and 5t where t represents a time interval at which said print hammers in each group are successively released.

6. The dot line printer according to claim 1, wherein L and N are equal to 6 and 3, respectively, and wherein said print hammers in each group are arranged so that adjacent print hammers are released with a time delay of t where t represents a time interval at which said print hammers in each group are successively released.

7. The dot line printer according to claim 1, wherein L and N are equal to 6 and 4, respectively, and wherein said print hammers in each group are arranged so that adjacent print hammers are released with a time delay of one of t and 2t where t represents a time interval at which said print hammers in each group are successively released.

8. The dot line printer according to claim 1, wherein N is an odd number $N_o$ which is expressed as $N_o=2n_o+1$ where $n_o$ is an integer equal to or greater than 1, and wherein a minimum firing time difference $t_o$ between adjacent print hammers in said group is determined by $$t_o=n_o \cdot T/(2n_o+1)$$

where T is a repeatability of the print hammer.

9. The dot line printer according to claim 1, wherein N is an even number $N_e$ which is expressed as $N_e=2n_e$ where $n_e$ is an integer equal to or greater than 2, and wherein a minimum firing time difference $t_e$ between adjacent print hammers in said group is determined by $$t_e=(n_e-1) \cdot T/2n_e$$

where T is a repeatability of the print hammer.

* * * * *